US005158739A

United States Patent [19]

Gente et al.

[11] Patent Number: 5,158,739

[45] Date of Patent: Oct. 27, 1992

[54] DEVICE FOR DISMANTLING AN IRRADIATED COMPONENT OF A NUCLEAR REACTOR BY MACHINING ITS WALL

[75] Inventors: Daniel Gente, Villeurbanne; Bernard Magnin, Saint Victor Sur Rhins, both of France

[73] Assignee: Framatome, Courbevoie, France

[21] Appl. No.: 721,415

[22] Filed: Jun. 26, 1991

[30] Foreign Application Priority Data

Jun. 27, 1990 [FR] France ..... 90 08118

[51] Int. Cl.[5] ..... G21C 19/00

[52] U.S. Cl. ..... 376/260; 82/1.11; 82/128; 409/137; 409/132; 409/179

[58] Field of Search ..... 376/260; 29/426.4, 426.3, 29/723; 83/930; 82/128, 113, 1.11; 51/241 S, 241 R; 299/87, 18; 409/137, 178, 179, 134, 310, 313, 293, 131, 132

[56] References Cited

U.S. PATENT DOCUMENTS

| | | | |
|---|---|---|---|
| 2,706,432 | 4/1955 | Daugherty | 90/11 |
| 3,908,491 | 9/1975 | Gilmore | 82/4 C |
| 4,594,774 | 6/1986 | Barker et al. | 29/723 |
| 4,708,571 | 11/1987 | Sappok | 414/412 |
| 4,813,313 | 3/1989 | Ichikawa et al. | 82/128 |
| 4,818,472 | 4/1989 | Operschall et al. | 376/260 |
| 5,001,870 | 3/1991 | Yokota et al. | 51/410 |

FOREIGN PATENT DOCUMENTS 2554256 7/1985 Fed. Rep. of Germany .

OTHER PUBLICATIONS

"Disposal device . . . material"-vol. 14 #191-Apr. 18, 1990.

"Robot for . . . reactor"vol. 13, #475-Oct. 27, 1989.

"Method for cutting . . . structure"-vol. 13 #324-Jul. 21, 1989.

*Primary Examiner*—Brooks H. Hunt

*Assistant Examiner*—Chrisman D. Carroll

*Attorney, Agent, or Firm*—Pollock, Vande Sande & Priddy

[57] ABSTRACT

The tubular wall (1) of the irradiated component is machined on its upper annular surface, with chips (44) being formed by the use of a metal working machine (30) bearing on this upper surface and moving in rotation about the axis (6) of the wall (1) of the component. The chips (44) formed by the metal working machine (30), e.g., a milling head, which moves in the vertical direction and downwards, are collected and cleared away continuously during the progress of the machining in the axial direction (6) of the wall (1) of the component. The device is fastened to the upper part of the tubular casing (1), arms (*7a, 7b*) equipped with jacks allowing the device (4) to be flanged to the wall (1) of the component, and bearing devices (12) comprising arms (13) being mounted pivotably about a horizontal axis between a low bearing position and a high withdrawal position (13'). The bearing arms (13) change from their low position to their high position at the moment when the machining tool (31) passes.

6 Claims, 1 Drawing Sheet

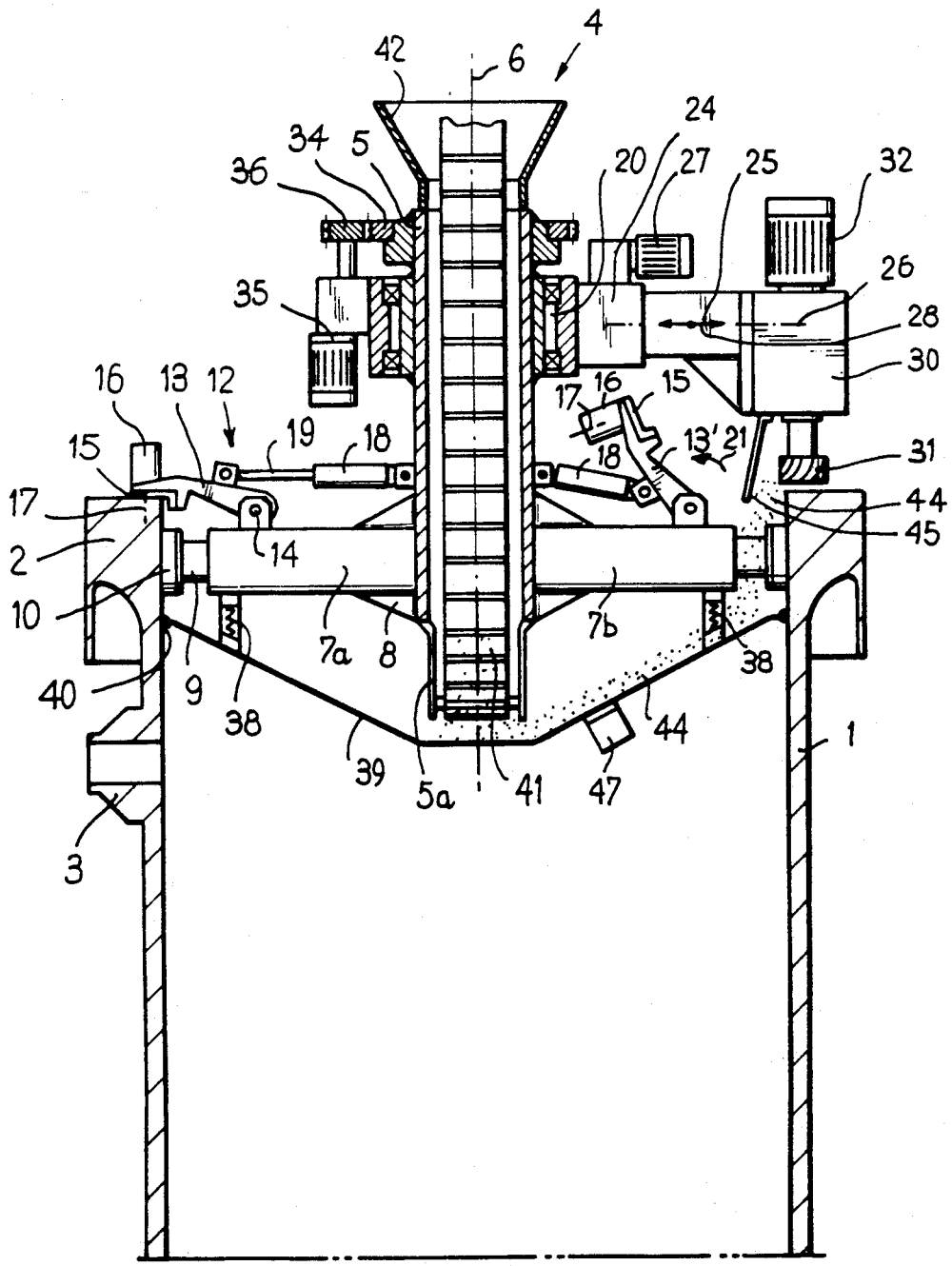
4
42
6
24
34
5
20
27
25
32
36
26
35
28
30
16
13
12
16
15
17
19
18
13'
21
31
15
18
17
44
45
2
14
10
7a
8
7b
38
40
9
38
44
1
39
5a
41
47
3

DEVICE FOR DISMANTLING AN IRRADIATED COMPONENT OF A NUCLEAR REACTOR BY MACHINING ITS WALL

FIELD OF THE INVENTION

The invention relates to a device for dismantling an irradiated component of a nuclear reactor, especially a vessel of a nuclear reactor cooled by pressurized water, by machining its wall, with chips being removed.

BACKGROUND OF THE INVENTION

Water-cooled nuclear reactors, especially pressurized-water nuclear reactors, comprise a vessel which is intended for containing the core of the nuclear reactor and which is connected to the cooling circuit of the reactor in which the cooling water circulates.

The wall of the reactor vessel, which is in contact with the cooling fluid and which is exposed to the radiation emitted by the reactor core, can become highly contaminated after the reactor has been operating for some time.

As regards nuclear power stations which have reached the end of their useful life and which need to be shut down completely, the solution adopted in the past has been to leave these power stations in their existing state and to allow the activity of the constituent materials of their components to decrease, in order to dismount them at a later data under more satisfactory conditions than at the time of the shutdown, without the need to use complex remotely controlled tools.

A substantial increase in the number of power stations put out of industrial operation is to be expected in the future, and therefore it is necessary to consider dismantling these power stations so as to restore the site where they are built to its original state.

The dismantling of the conventional part of the power station presents no particular problem, but in contrast the dismantling of the part of the power station forming the actual nuclear reactor raises problems which are difficult to solve because of the radioactive emissions of the constituent materials of the reactor components.

In particular, the vessel of water-cooled nuclear reactors, which contains the fuel assemblies and which is in contact with the cooling water of the reactor during its operation, is very highly contaminated in the case of reactors which have reached the end of their useful life.

As regards to pressurized-water nuclear reactors currently in operation, the reactor vessel takes the form of a body of generally cylindrical shape closed by domed bottoms, of large size and having a large wall thickness.

The vessel, which has a very high mass, is arranged inside a vessel well formed in a concrete structure which also delimits one or more pools located above the upper level of the vessel.

The vessel, which contains various internal structures, in addition to the fuel assemblies, is connected by means of connection pieces to pipelines of the primary circuit of the reactor.

The core assemblies and some components of the internal structures can be dismounted and taken out of the vessel, in order to obtain their removal and, where appropriate, their elimination, at the time when the reactor is put out of operation.

To date, there have been no known processes and devices for safely dismantling the vessel of a pressurized-water nuclear reactor and in particular makes it possible to avoid risks of radioactive contamination in the work zone, while at the same time using machining and handling means of relatively simple structure to effect the removal and elimination of the material of the vessel.

SUMMARY OF THE INVENTION

The object of the invention is, therefore, to provide a device for dismantling an irradiated component of a nuclear reactor having at least one wall of tubular shape arranged with its axis in the vertical direction, this device making it possible to carry out, under simple and very safe conditions, the elimination of the material of the component wall by machining, with chips being removed, and the clearing away of the chips obtained.

To achieve this object:

- the tubular wall is machined on its upper annular surface, with chips being formed, by the use of a metal working machine bearing on this upper surface and moving in rotation about the axis of the component,
- and the chips formed by the metal working machine, which moves in the vertical direction and downwards, are collected and cleared away continuously during the progress of the machining in the axial direction of the component.

The invention also relates to a device carrying out the dismantling process according to the invention.

BRIEF DESCRIPTION OF THE DRAWINGS

To make it easier to understand the invention, an embodiment of the dismantling device according to the invention and the device will now be described by way of example with regard to the dismantling of a vessel of a pressurized-water nuclear reactor.

The single figure is a front elevation view in vertical section of the upper part of a vessel of a pressurized-water nuclear reactor and of a device ensuring the dismantling of this vessel by means of the process according to the invention.

DESCRIPTION OF THE PREFERRED EMBODIMENT

The figure shows the upper part of the vessel 1 of a pressurized-water nuclear reactor, which consists of a casing of tubular shape having a large wall thickness and arranged with its axial vertical within a vessel well formed in a concrete structure (not shown).

The upper part of the tubular vessel comprises a flange 2 having a thickness greater than that of the wall of the vessel in its running part. The flange 2 is intended for receiving the vessel cover ensuring a sealing closure of the inner volume of the vessel during the operation of the reactor.

In the vicinity of its upper part, vessel 1 also comprises connection pieces 3, allowing the vessel to be connected to the pipelines of the primary circuit.

The drawing illustrates a device making it possible to carryout the dismantling of the vessel by machining its wall, with chips being removed.

After final shutdown of the nuclear reactor, the primary circuit and the vessel are cooled and the vessel cover is removed, the reactor pool located above the vessel being filled with water.

Both the core assemblies and the internal equipment of the vessel are unloaded and taken away.

The reactor pool is subsequently emptied, as is the vessel which can nevertheless be partially filled with water while the dismantling is being carried out.

A dismantling device making it possible to carry out the process according to the invention is installed on the upper part of the vessel 1 by means of the polar bridge of the power station or by other suitable lifting and handling means.

The drawing shows dismantling device 4 in operating position on the upper part of the vessel 1.

The device 4 comprises a tubular support 5 which, in the operating position, is arranged with its axis coinciding with the axis 6 of the vessel 1.

Four arms of large cross-section, such as the arms 7*a* and 7*b*, are fastened rigidly to the lower part of the support 5 by means of fastening brackets 8 in radial directions perpendicular to the axis 6 arranged at 90° relative to one another about the axis 6 of the support 5.

The arms, such as 7*a* and 7*b*, are machined internally in their axial direction, to form jack chambers, in which move rods 9 carrying, at their ends, blocks 10 bearing on the inner wall of the vessel 1.

The arms, such as 7*a* and 7*b*, ensure fastening and centering of the device 4 by flanging within the vessel when the jack rods 9 are in their extended position.

Fastened to the upper part of each of the arms, such as 7*a* and 7*b*, is a bearing device 12 making it possible to cause the device 4 as a whole to rest on the upper annular surface of the vessel 1, in order to ensure its retention independently of the flanging obtained by the set of radially directed rams, such as 7*a* and 7*b*.

Each of the bearing devices 12 comprises an arm 13 mounted pivotably on the corresponding arm by means of a joint 14 of horizontal axis. The pivoting arm 13 comprises, at its end opposite the joint 14, a bearing piece 15 coming to rest on the upper annular surface of the vessel 1 when the arm 13 is in its low position, as shown in the left-hand part of the drawing, above the arm 7*a*.

The position of the bearing surface 15 in the direction of an axis 17 perpendicular to this bearing surface can be adjusted by means of a compensating device 16, the functioning of which will be explained later in the test.

A jack 18 for actuating the arm 13 is fastened in an articulated manner to the outer surface of the tubular support 5. The rod 19 of the jack 18 is connected to the arm 13, likewise in an articulated manner.

The axes of articulation of the jack 18 and of the rod 19 extend in a horizontal direction.

As a result of the actuation of the double-acting jack 18 in one direction or the other, the arm 13 can be put in a low bearing position, as shown on the left in the drawing, or in a raised position 13', as shown in the right-hand part of the drawing, the movement of the arm 13 by pivoting between these two positions being represented schematically by the arrow 21.

The tubular support 5 carries, in the vicinity of its upper part, a rotary bearing 20 coaxial with support 5 and vessel 1. The bearing 20 is bearing comprising a stationary inner ring fixed to the support 5 and a rotationally movable outer ring to which a support 24 is fastened.

A radially directed arm 25 is mounted within the support 24 for movement in a direction 26 corresponding to its longitudinal direction.

A geared motor 27 ensuring the drive of a rack-and-pinion assembly mounted in the support 24 makes it possible to move the arm 25 to and fro in the direction 26, as represented schematically by the arrow 28.

The arm 25, at its end opposite the support 24, carries a milling head 30 forming the tool for eliminating the irradiated material of the wall of the vessel 1 by machining. The milling head 30 has a milling cutter 31 mounted at the end of a vertically directed spindle driven in rotation by means of a motor 32.

The support 5, at its upper end, carries a stationary gear ring 34 above the bearing 20. A geared motor 35 fastened to the movable outer ring of the bearing 20 carries, at the end of its output shaft, a driven pinion 36 meshing with the stationary toothed ring 34.

Setting the geared motor 35 and the pinion 36 in rotation makes it possible to drive the outer ring of the bearing 20, the support 24 and the milling head 30 in rotation about the axis 6 of the vessel.

The arms, such as 7*a* and 7*b*, carry, by means of flexible fastening devices 38, a collecting hopper 39 of frustoconical shape having along its upper edge, a peripheral gasket 40 the diameter of which is substantially equal to the inside diameter of the vessel 1. The gasket 40 makes it possible to obtain a sealing connection between the outer upper edge of the collecting hopper 39 and the inner surface of the vessel 1.

A vertically directed conveyor 41, connected in its lower part to an extension 5*a* of the support 5, is mounted vertically within the support 5, so as to discharge, through its upper part, into an outwardly flared conduit 42.

The machining of the upper surface of the vessel 1 by milling in accordance with the procedure described below gives rise to the formation of metal chips and particles of metal 44 which are steered by a deflector 45 in the direction of the collecting hopper 39. The chips and particles 44 coming in contact with the inner surface of the hopper 39 travel by gravity towards the bottom of the hopper, this movement of the chips and particles being facilitated by the presence of a vibrator 47 in contact with the outer surface of the hopper 39.

The chips and particles gathering in the lower central part of the hopper 39 are picked up by the conveyor 41 and transported within the support 5 as far as its upper part, in order to be discharged onto a handling device or into a hopper making it possible to feed an induction furnace carrying out the remelting of the chips and particles of irradiated material of the vessel wall. The flared conduit 42 makes it possible to ensure complete recovery of the chips and particles at the upper part of the conveyor 41, since some of these chips or particles can be thrown outside their normal transport path, thereby bringing about contamination of the milling device by these particles of radioactive material.

To carry out an operation of dismantling a vessel 1 of a pressurized-water nuclear reactor, the device 4 is put in its operating position on the upper part 2 of the vessel, consisting of the fastening flange for the cover. The bearing devices 12, the arms 13 of which are put in the low position, come to rest with their bearing pieces 15 on the upper surface of the flange 2.

The device described, and can comprise more than two arms by feeding the jacks formed in the arms, such as 7*a* and 7*b*. The blocks 10 come in contact with the inner surface of the vessel in order to obtain the flanging.

The milling cutter 31 which, at the start of the operation, is in a position set back towards the inside of the vessel, is set in rotation, and the arm 25 is moved outwards, so that the milling cutter, the vertical position of which is adjusted by means of the compensating devices 16 of the bearing pieces 15 of the arms 13, can engage into the metal of the vessel wall 1 over a thickness corresponding to the thickness of a machining pass.

The movable outer ring of the bearing 20, the support 24, the arm 25 and the milling head 30 are set in rotation about the axis 6 of the vessel by feeding the geared motor 35.

The milling head 30, rotating about the axis 6, executes a machining pass over the upper annular surface of the vessel.

When the milling cutter comes into the vicinity of a bearing device 12, the arm 13 of which is in the low position, a detector makes it possible to control the corresponding jack 18 by means of a servo valve. The arm 13 is moved by pivoting so as to assume a raised position, such as the position 13'.

The compensating device 16 ensures the outward movement of the bearing piece 15 over a distance corresponding to the thickness of the pass.

When the milling cutter has carried out the machining on the part of the upper surface of the vessel on which the piece 15 of the arm 13 comes to bear, a detector controls the movement of the jack 18 in the direction causing the arm 13 to be turned downwards, the bearing piece 15 coming in contact with the freshly machined surface of the vessel wall. The adjustment of the position of the bearing piece 15 makes it possible to ensure that this bearing piece is put in perfect contact with the upper surface of the vessel when the pivoting arm 13 is turned down and kept in position by the rod 19 of the jack 18 in its extended position.

The machining pass is executed during a complete revolution of the milling head 30 about the axis 6 of the vessel, the arms 13 of the bearing devices 12 being moved into their high position at the moment when the milling cutter passes level with them.

In the thickest parts of the vessel, for example in the region of the vessel flange 2 and the connection pieces 3, the complete machining of the upper surface of the vessel over the thickness of one pass may require a radial movement of the milling cutter and the execution of a plurality of machining passes.

When the upper part of the vessel 1 has been machined over a thickness corresponding to a machining pass, the milling head 30 is returned to its initial position and the rods 9 of the jacks associated with the arms, such as *7a* and *7b*, are put in their retracted position, so as to release the blocks 10 for flanging the device 4 within the vessel.

The device 4 rests on the bearing devices 12 which are maintained in the low position by means of the jacks 18.

The compensating devices 16 are then reinitiated, so that they can make the adjustments, at the moment when the milling cutter passes, during the following machining pass.

The jacks associated with the arms, such as *7a* and *7b*, are actuated so as to ensure the flanging of the device 4 within the vessel.

A new machining pass is then executed, as before.

The chips and particles formed by the milling cutter 31 are recovered continuously by the hopper 39 and the vertical conveyor 41, so as to be introduced continuously into a remelting induction furnace.

The vessel is dismantled by the elimination of the metal of its wall during successive milling passes.

All the operations described above are controlled automatically, with the result that the dismantling of the vessel is carried out within the concrete structure in which the vessel well is formed, without any human involvement. This avoids exposing operators in a highly contaminated zone.

Moreover, the cutting state of the milling cutter is checked and tracked automatically, so as to make an automatic change of this milling cutter when its state is considered to be defective. There can also be programmed sequences for changing the tool after the device for dismantling by machining has been operating from some time.

The tool change is carried out in the conventional way by means of a robotized auxiliary arm which picks up the milling cutter from the milling head in order to introduce it into a magazine or rack and then to install a new milling cutter having a satisfactory cutting state.

The dismantling process and device according to the invention therefore make it possible to carry out the dismantling of a nuclear reactor vessel completely automatically, with the result that the period of time necessary for carrying out the machining is of only secondary importance.

It is possible to use the same device for dismantling by machining in order to carry out successively the dismantling of all the vessels of a group of nuclear reactors.

Moreover, the recovered irradiated material can usually be conditioned by remelting and casting, in order to form blocks of irradiated material of a mass and shape facilitating long-term storage.

The machining of the vessel wall can be carried out by using a device different from the one described, e.g., a metal working machine other than a milling head.

The means for moving, holding and centering the metalworking machine can be different from those described, and can comprise more than two arms, to ensure the flanging of the machine on the tubular wall.

All the handling means making it possible to recover the chips or particles and transport them towards a melting or recovery device can also be different from those described.

Finally, the invention is used for the dismantling of any component of a nuclear reactor having at least one part of tubular shape arranged with its axis vertical.

We claim:

1. Device for dismantling an irradiated component of a nuclear reactor having at least one wall of tubular shape and having a vertically oriented axis, said device comprising;

(a) a support;

(b) means for fastening said support to an upper part of a tubular wall, said means comprising at least two flanging arms fixed to said support and radially disposed within said tubular wall when said device is in an operating position, and bearing and flanging jacks movable in a longitudinal direction at an outer end of said bearing and flanging jacks, and bearing devices each associated with a flanging arm and comprising a bearing arm mounted for pivoting movement about a horizontal axis on a corresponding flanging arm;

(c) an actuating device for moving each said bearing arm between a low bearing position and a high withdrawal position;

(d) a metal working machine for machining an upper surface of said tubular wall;

(e) means for supporting said metal working machine on said support for rotation about an axis of said tubular wall;

(f) means for driving said metal working machine in rotation about said axis of said tubular wall of said irradiated component; and (g) means for collecting and clearing away particles formed by machining of said tubular wall.

2. Device according to claim 1, wherein each of said bearing arms comprises a piece bearing on said upper surface of said tubular wall and having a substantially planar bearing surface, a compensating device being provided for adjusting a position of said bearing surface.

3. Device according to claim 1, wherein said metal working machine is fastened to an end of a supporting arm movable in a longitudinal direction in relation to said support of said dismantling device, said supporting arm extending radially relative to said tubular wall in said operating position of said dismantling device.

4. Device according to claim 1, wherein said means for collecting and clearing away particles of irradiated material obtained by machining comprise a frustoconical hopper fastened to an inside of said tubular wall underneath said metal working machine, so as to recover said particles and gather them in a central part of said hopper and a substantially vertical conveyor having a lower part located adjacent said central part of said hopper.

5. Device according to claim 4, comprising a vibrator in contact with a wall of said hopper, to assist movement of said particles towards said central part of said hopper.

6. Device according to claim 4, wherein said support is tubular and coaxial with said irradiated component when said device is in operating position, and conveyor being vertically disposed within said tubular support.

* * * * *